US006813601B1

(12) United States Patent
Hedinger

(10) Patent No.: US 6,813,601 B1
(45) Date of Patent: Nov. 2, 2004

(54) HIGHLY COMPRESSED VOICE AND DATA TRANSMISSION SYSTEM AND METHOD FOR MOBILE COMMUNICATIONS

(75) Inventor: Robert A. Hedinger, Red Bank, NJ (US)

(73) Assignee: Loral SpaceCom Corp., New York, NY (US)

( * ) Notice: Subject to any disclaimer, the term of this patent is extended or adjusted under 35 U.S.C. 154(b) by 866 days.

(21) Appl. No.: 09/132,450

(22) Filed: Aug. 11, 1998

(51) Int. Cl.[7] ..... G10L 19/00
(52) U.S. Cl. ..... 704/221; 704/501
(58) Field of Search ..... 704/235, 260, 704/221, 501, 504

(56) References Cited

U.S. PATENT DOCUMENTS 4,975,957 A * 12/1990 Ichikawa et al. ..... 704/235
5,956,681 A * 9/1999 Yamakita ..... 704/235

* cited by examiner

*Primary Examiner*—David D. Knepper

(74) *Attorney, Agent, or Firm*—Karambelas & Associates

(57) ABSTRACT

Compression of voice and data signals by at least an order of magnitude that permits greater use of the limited bandwidth at the low frequency of operation. A voice recognition system that converts words spoken into a microphone into a sequence of letters and gaps. An encoder codes the letters into a digital message. A transmitter transmits the digital message to a receiver over a communications link. The received digital message is decoded in a decoder and a speech synthesizer converts the decoded message into spoken words that are annunciated on a speaker. In addition, an initial message that identifies a stored voice type that is to be synthesized, or a simultaneous signal that tailors the voice synthesizer in real time as the voice of the speaker changes may be transmitted to cause the speech synthesizer to more accurately resemble a speaker's voice. A speech-to-text processor and a display may be used to display the message at the receiver for hearing impaired users and users located in noisy areas. This feature may also be used to transmit messages to a digital storage device coupled to the speech-to-text processor. A digital interface to the transmitter may be provided for nonspeaking individuals to communicate using a keypad or similar device to generate the message to be transmitted. This feature may also be used for transmitting stored files to the receiver.

7 Claims, 2 Drawing Sheets

HIGHLY COMPRESSED VOICE AND DATA TRANSMISSION SYSTEM AND METHOD FOR MOBILE COMMUNICATIONS

BACKGROUND

The present invention relates generally to mobile communication systems, and more particularly, to a highly compressed voice and data transmission or communication system and method that may be used for mobile communications.

In most mobile communications systems it is necessary to use low frequency radio waves in order to achieve building penetration and to achieve practical omnidirectional antenna systems. At low frequencies, there is limited bandwidth that is available. Furthermore the bandwidth that is available is also typically used for other applications. For these reasons it is necessary to use the available spectrum (bandwidth) as efficiently as possible. To date, a digital voice compression ratio of about 10 to 1 is about the best that has been achieved with acceptable quality. This requires transmission data rates of approximately 5 kbps and bandwidths of approximately the same numerical value in kHz.

It would therefore be desirable to have an improved voice and data transmission or communication system and method that highly compresses voice and data signals to improve the use of the limited available frequency bandwidth, and to overcome limitations of conventional approaches. Accordingly, it is an objective of the present invention to provide for a voice and data transmission or communication system and method that compresses data to provide for an improved low frequency mobile communications system.

SUMMARY OF THE INVENTION

To accomplish the above and other objectives, the present invention provides for a communication system and method that compresses voice and data signals by at least an order of magnitude compared to the 10:1 conventional data compression ratio. The present system and method combines the use of several currently available technologies to achieve this dramatic improvement in compression. The large compression ratio achieved by the present invention permits greater use of the limited bandwidth at the low frequency of operation of the communication system.

An exemplary system comprises a voice recognition system that converts spoken words into a sequence of letters and gaps. An encoder is used to code the letters into a digital message. A transmitter is used to transmit the digital message to a receiver over a mobile communications link (such as a cellular communications network). The receiver is used to decode the digital message and a speech synthesizer is used to convert the decoded message into spoken words.

The system is symmetrical so that a normal voice conversation may take place between two individuals. Each individual uses a device containing the voice recognition system, encoder, transmitter, receiver and speech synthesizer. Each device is coupled to a microphone and a speaker, such as those used in a normal telephone system, to serve as an interface to a human ear and voice, respectively.

The system may optionally use a special function that causes the speech synthesizer to more accurately resemble a speaker's voice. This is accomplished by transmitting an initial message that identifies one of a plurality of stored voice types that is to be synthesized, or by sending a simultaneous signal that tailors the voice synthesizer in real time as the voice of the speaker changes.

The system may also optionally use a visual display for displaying the message at the receiver for hearing impaired users and users located in noisy areas. This may be implemented using a speech-to-text processor coupled to a display. This feature may also be used to transmit messages to a digital storage device coupled to the decoder, for example.

The system may also optionally use a digital interface to the transmitter so that nonspeaking individuals may communicate with a key pad or other device that is used to generate the message to be transmitted. This feature may also be used for transmitting stored files to the receiver for use at the receiving end of the system.

In an exemplary method, words are spoken into a microphone by an individual that are to be transmitted to an second individual. The spoken words are converted into a sequence of letters and gaps using a voice recognition system. The sequence of letters is then coded into a digital message. The digital message is then transmitted to a receiver over a mobile communications link. The digital message is decoded at the receiver. The decoded digital message is converted into spoken words using a speech synthesizer. The converted into spoken are then broadcast using a speaker so that the receiving individual can hear what was spoken at the other end of the communication link.

The system and method are symmetrical so that a normal voice conversation may take place between two individuals each using a device containing a transmitter and a receiver. This device is coupled to a microphone and a speaker of a normal telephone system to serve as an interface to a human ear and voice, respectively.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
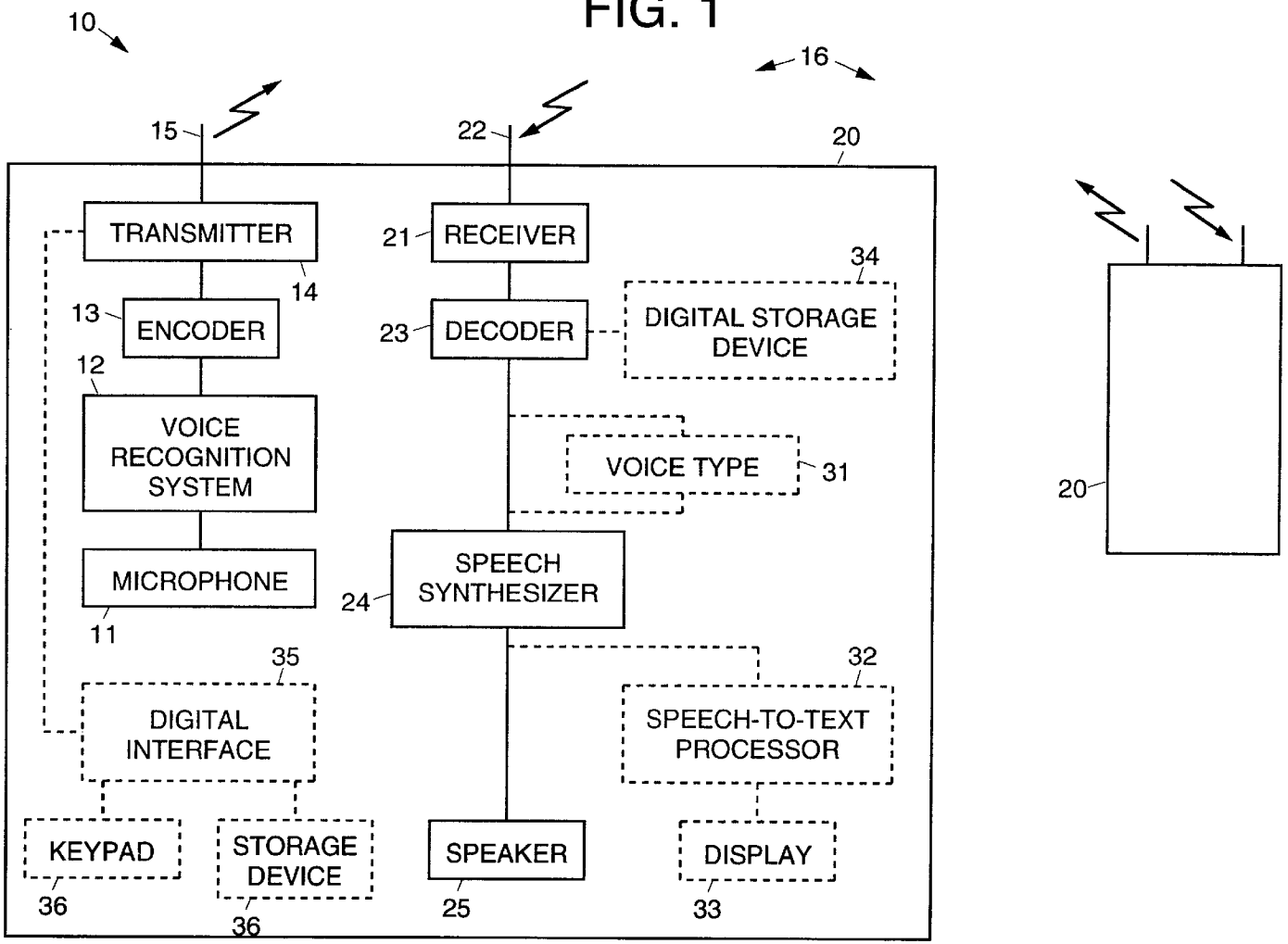
FIG. 1 illustrates an exemplary communication system in accordance with the principles of the present invention.

Referring to the drawing figures, FIG. 1 illustrates an exemplary communication system 10 in accordance with the principles of the present invention. The system 10 compresses voice and data signals by at least an order of magnitude (at least 100:1) compared to the 10:1 ratio used in conventional voice compression systems. The large compression ratio achieved by the system 10 permits greater use of the limited voice transmission bandwidth at the low frequency of operation of the system 10.

The system 10 comprises a microphone 11 into which words are spoken that are to be transmitted as part of a conversation between individuals, for example. A voice recognition system 12 is coupled to the microphone 11 that converts the spoken words into a sequence of letters and gaps. The voice recognition system 12 may be a model In-cube Version 2 manufactured by Command corp. Inc., for example. An encoder 13 is coupled to the voice recognition system 12 that is used to code the letters into a digital message. The encoder 13 may be a standard PC with Virtual Basic 4 and a text-to-data software algorithm. A transmitter 14 having an antenna 15 is coupled to the encoder 13 that is used to transmit the digital message to a receiver 21 over a mobile communications link 16, such as a cellular communications network, for example. The transmitter 14 may be a model TX2 manufactured by Radiometrix, for example.

The receiver 21 has an antenna 22 and receives the transmitted digital messages for processing. The receiver 21 may be a model RX2 manufactured by Radiometrix, for example. The receiver 21 is coupled to a decoder 23 that is used to decode the digital message. The decoder 23 may be a standard PC with Virtual Basic 4 and a text-to-data software algorithm for example. A speech synthesizer 24 is coupled to the decoder 23 and is used to convert the decoded message into spoken words. The speech synthesizer 24 may be a standard PC with DECTALK PC Version 4.2, for example. The converted spoken words are output to a speaker 25 so that the receiving individual can hear what was said by the other individual.

The system 10 is symmetrical so that a normal voice conversation may take place between two individuals. Each individual uses a device 20 containing the voice recognition system 12, the encoder 13, the transmitter 14, the receiver 21, the decoder 22 and the speech synthesizer 23. Each device 20 is coupled to the microphone 11 and speaker 25, such as those used in a normal telephone system, to serve as an interface to a human ear and voice, respectively.

An optional feature of the system 10 is the use of a special function that causes the speech synthesizer 24 to more accurately resemble a speaker's voice. This is accomplished by transmitting an initial message that identifies one of a plurality of stored voice types that is to be synthesized, or by sending a simultaneous signal that tailors the voice synthesizer in real time as the voice of the speaker changes.

Another optional feature is the use of a visual display for displaying the message at the receiver for hearing impaired users and users located in noisy areas. This may be implemented using a speech-to-text processor 32 coupled to a display 33. The speech-to-text processor 32 processes the output of the speech synthesizer 24 to produce text that is displayed to the user. This feature may also be used to transmit messages to a digital storage device 34 coupled to the speech-to-text processor 32, for example. The output of the speech-to-text processor 32 comprises text that may be readily stored on the digital storage device 34.

Another optional feature is to provide a digital interface 35 to the transmitter 14 so that nonspeaking individuals may communicate with a keypad 36 or similar device that is used to generate the message to be transmitted. This feature may also be used for transmitting stored files to the receiver 21 by coupling a storage device 37 to the digital interface 35.

Figure 2:
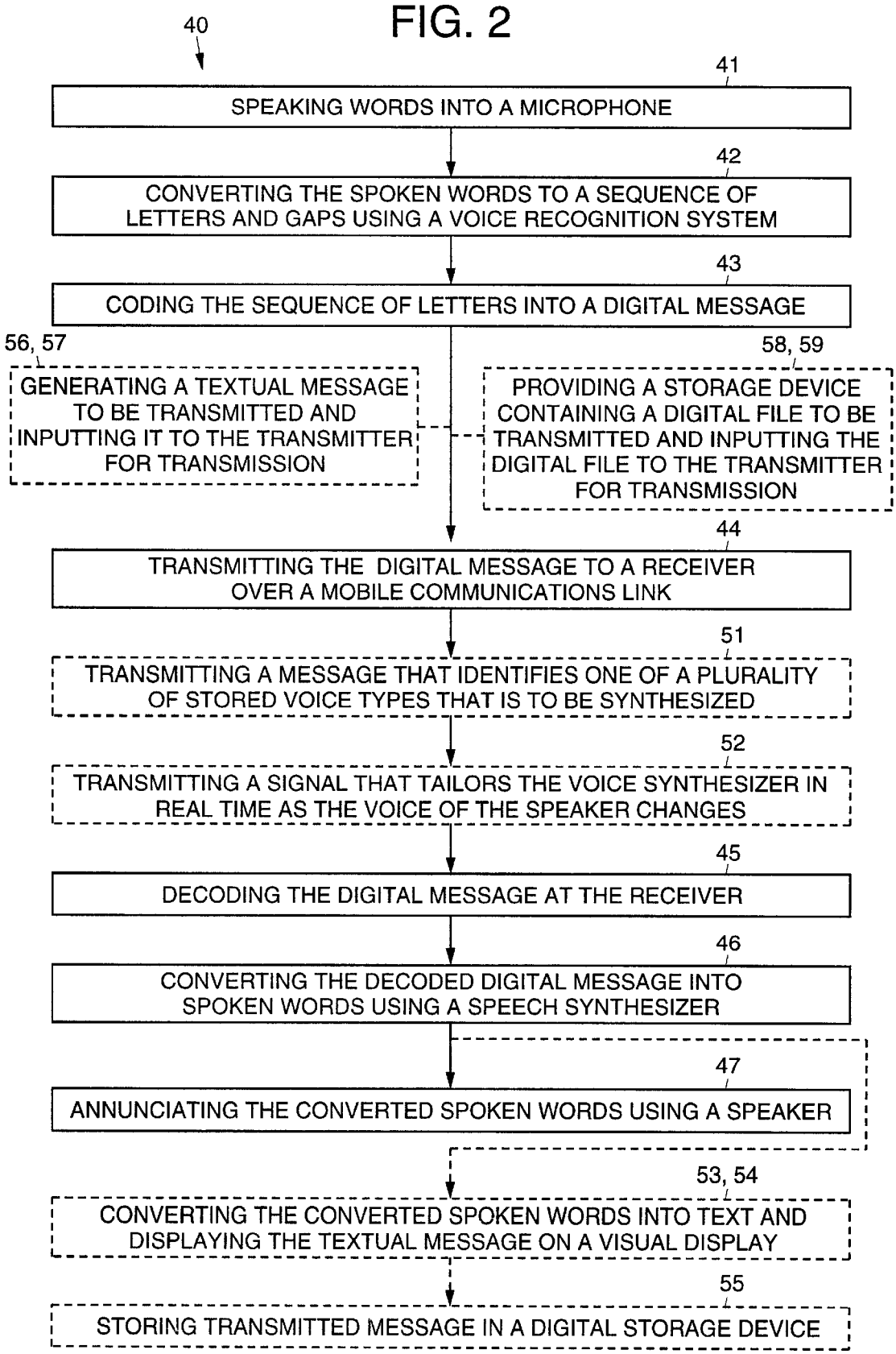
FIG. 2 illustrates an exemplary communication method in accordance with the principles of the present invention.

Referring now to FIG. 2, it illustrates an exemplary communication method 40 in accordance with the principles of the present invention. The exemplary method 40 comprises the following steps.

Words are spoken 41 into a microphone by an individual that are to be transmitted to an second individual. The spoken words are converted 42 into a sequence of letters and gaps using a voice recognition system. The sequence of letters is then coded 43 into a digital message. The digital message is transmitted 44 to a receiver over the mobile communications link 16. The digital message is decoded 45 at the receiver. The decoded digital message is converted 46 into spoken words using a speech synthesizer. The converted spoken words are then broadcast 47 or annunciated 47 using a speaker 25 so that the receiving individual can hear what was spoken at the other end of the communication link 16.

In addition, additional method steps may be employed to implement other aspects of the present invention. A message may be transmitted 51 that identifies one of a plurality of stored voice types that is to be synthesized. A signal may be transmitted 52 that tailors the voice synthesizer 24 in real time as the voice of the speaker changes. The converted spoken words may be converted 53 into text and displayed 54 on a visual display 33. The transmitted messages may be stored 55 in a digital storage device 34. A textual message may be generated 56 that are to be transmitted and the textual message may be input 57 to the transmitter 14 for transmission, which permits text to be transmitted over the communication link 16. Also, a storage device 37 containing a digital file to be transmitted may be provided 58 and the digital file may be input 59 to the transmitter 14 for transmission.

Thus, a voice transmission system and method have been disclosed that highly compresses voice data to provide for an improved low frequency mobile communications system. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A communication system comprising:

a plurality of devices that each comprise:

a microphone into which words are spoken that are to be transmitted;

a voice recognition system coupled to the microphone for converting the spoken words into a sequence of letters and gaps;

an encoder coupled to the voice recognition system for coding the letters into highly compressed digital messages;

a transmitter coupled to the encoder for transmitting the highly compressed digital messages over a low frequency mobile communications link;

a receiver for receiving the transmitted digital messages for processing;

a decoder coupled to the receiver for decoding the digital messages;

a speech synthesizer coupled to the decoder for converting the decoded messages into spoken words; and a speaker coupled to the speech synthesizer for outputting the converted spoken words.

2. The communication system recited in claim 1 further comprising circuitry for transmitting a message that identifies one of a plurality of stored voice types that is to be synthesized.

3. The communication system recited in claim 1 further comprising circuitry for transmitting a signal that tailors the voice synthesizer in real time as the voice of the speaker changes.

4. The communication system recited in claim 1 further comprising:

a speech-to-text processor for converting the converted spoken words into text; and a visual display coupled to the speech-to-text processor for displaying the message.

5. The communication system recited in claim 4 further comprising:

a digital storage device coupled to the speech-to-text processor for storing transmitted messages.

6. The communication system recited in claim 1 further comprising:

a digital interface coupled to the transmitter; and a keypad coupled to the digital interface for generating a textual message to be transmitted.

7. The communication system recited in claim 6 further comprising:

a storage device coupled to the digital interface for transmitting digital files to the receiver.

* * * * *